United States Patent [19]

Sheth et al.

[11] 4,032,270

[45] June 28, 1977

[54] ROTARY VANE COMPRESSOR WITH IMPROVED VANE EXTENSION MEANS

[75] Inventors: Rajesh N. Sheth, Mount Prospect; Raymond L. Guzy, Morton Grove, both of Ill.

[73] Assignee: Borg-Warner Corporation, Chicago, Ill.

[22] Filed: May 28, 1976

[21] Appl. No.: 691,061

[52] U.S. Cl. ..... 418/266; 267/152; 418/238

[51] Int. Cl.[2] ..... F04C 29/00; F16F 3/08

[58] Field of Search ..... 418/122, 123, 129, 248, 418/259, 266, 267, 238, 142; 267/152, 153

[56] References Cited

UNITED STATES PATENTS

| | | | |
|---|---|---|---|
| 3,191,503 | 6/1965 | Fuehrer | 418/266 |
| 3,277,833 | 10/1966 | Hudgews | 418/122 X |
| 3,990,819 | 11/1976 | Ritchie | 418/124 X |

*Primary Examiner*—Carlton R. Croyle
*Assistant Examiner*—Leonard Smith
*Attorney, Agent, or Firm*—Richard J. Schlott

[57] ABSTRACT

A rotary sliding vane compressor having means for biasing the vanes outwardly. Such means include a resilient element located in the lower portion of the vane slot and engaging a convexly shaped edge on the vane. An improved wear surface on the resilient element at the area of contact with the vane slot provides enhanced service life. The flexing action of the resilient member ensures that the vanes will be moved outwardly during the expansion phase of rotor travel.

4 Claims, 6 Drawing Figures fig.4.
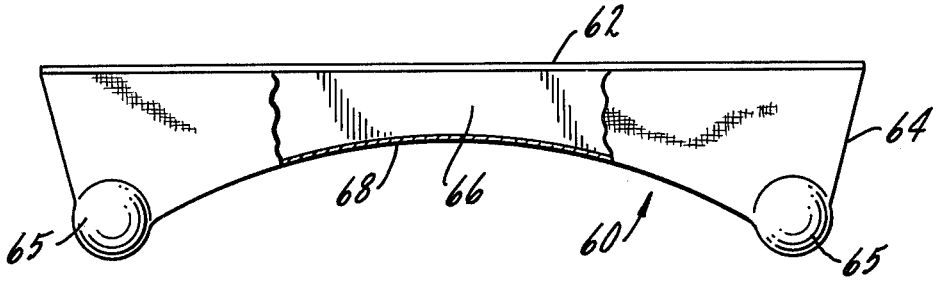
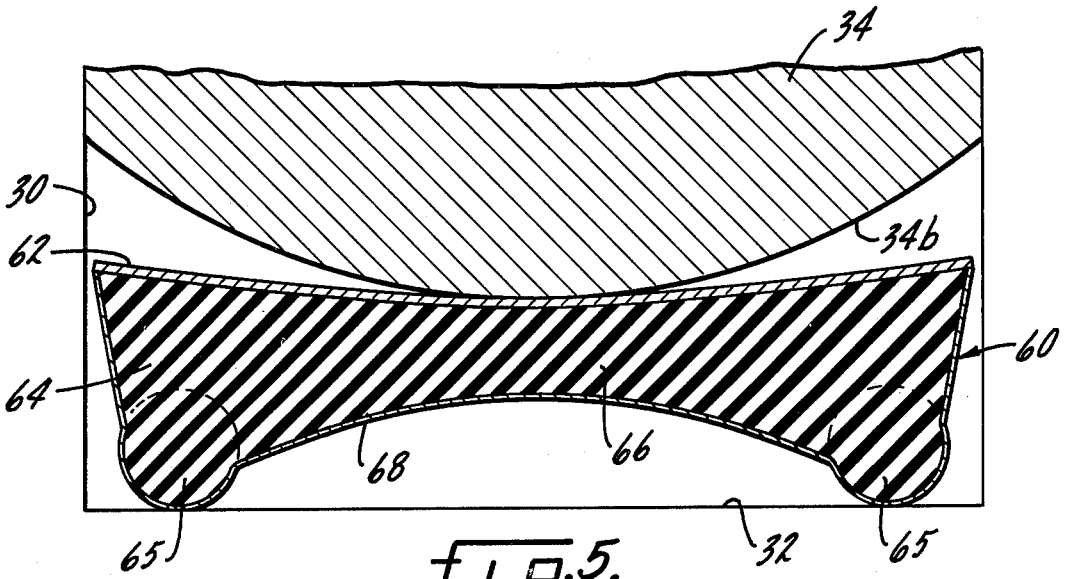
fig.5.
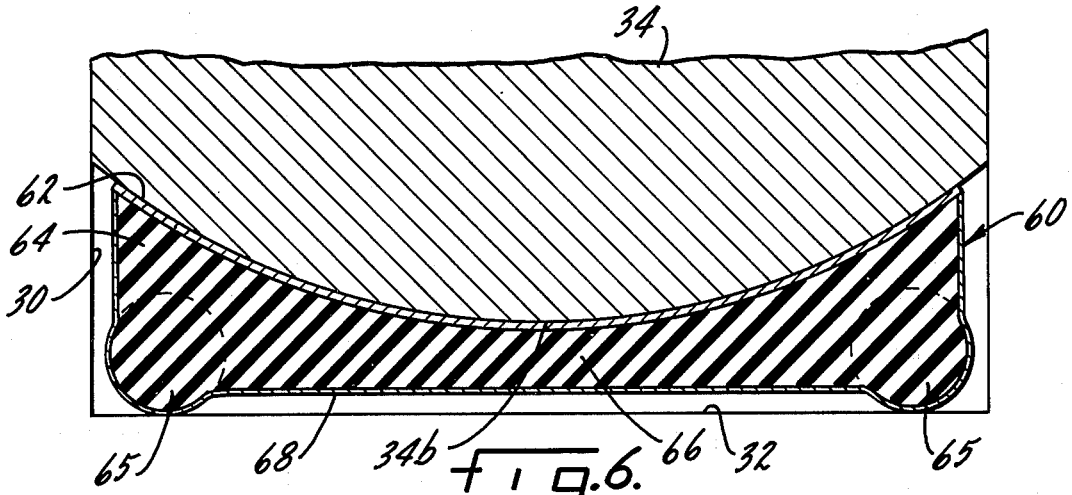
fig.6.

ROTARY VANE COMPRESSOR WITH IMPROVED VANE EXTENSION MEANS

BACKGROUND OF THE INVENTION

1. Field of the Invention

A rotary sliding vane compressor having means for urging the vanes outwardly and maintaining the vane tips in engagement with the cylinder wall during start-up and at rotational low speeds.

2. Description of the Prior Art

Burnett U.S. Pat. No. 3,376,825 describes a rotary vane compressor having a leaf type spring element between the radially inner portion of the vane and the bottom of the vane slot. The spring is designed so that during high speed operation, when centrifugal forces are sufficient to maintain the vane tips in contact with the cylinder wall, the same centrifugal forces will cause the spring to collapse against radially inner edges of the vane and thus become ineffective as a spring element.

English U.S. Pat. No. 1,984,365 describes a rotary sliding vane compressor having a leaf type spring in the bottom of the vane slot and having its convex side in contact with the central region of the vane edge which is essentially linear.

Kenney et al. U.S. Pat. No. 2,045,014 also discloses a leaf spring with its ends embedded in the bottom of the vane.

Fuehrer U.S. Pat. No. 3,191,503 shows a sliding vane fluid handling apparatus which uses O-rings of elastomeric material underneath the vanes to bias the same outwardly.

Gibson et al. U.S. Pat. No. 1,857,276 is representative of a large number of prior art references which utilize fluid pressure underneath the vanes to maintain the vane tips in engagement with the cylinder wall.

SUMMARY OF THE INVENTION

This invention relates in general to rotary sliding vane compressors and more particularly to an effective means for biasing the vanes radially outwardly to maintain the vane tips in sliding engagement with the cylindrical wall of the rotor chamber which forms the gas working space. Although rotor sliding vane compressors are known in a great many forms, the description herein is directed to a conventional type in which a rotor is provided with a plurality of extensible vanes each received with a generally radially oriented or canted vane slot in the rotor. The rotor is received within a cylindrical chamber or stator and mounted such that its axis is offset with respect to the cylindrical stator axis, thus providing a generally crescent shaped gas working space. The rotor is in sliding contact with a portion of the cylindrical wall, and this contact point divides the low pressure side from the high pressure side. An inlet port communicates with one side of the gas working space and a discharge port communicates with the opposite side. Gas is trapped between adjacent vanes and carried around through the compression zone. The volume of each pocket or compartment, as defined between adjacent vanes and the rotor and stator surfaces, becomes smaller as it approaches the discharge port thus compressing the gas trapped therein.

A problem is often encountered in operating compressors of the type described above in that the vanes sometimes will not maintain their tips in engagement with the cylindrical stator wall under all conditions. This is especially true at start-up when the rotor is travelling at low rotational velocities. The centrifugal force which would normally tend to throw the vanes outwardly is not sufficient to overcome the vacuum created when the vanes begin to move their most radially inward portion to the point directly opposite the contact point. The latter may be regarded as a dash-pot effect and is extremely powerful in resisting the outward thrust of the vanes.

Several techniques have been used in the prior art to hold the vane tips in engagement with the cylindrical wall. Basically, these may be divided into two categories: mechanical (such as spring) and hydraulic or pneumatic. The mechanical springs used may take many forms, such as the leaf springs described in Burnett, Kenney et al and English, or helical (coil) springs. Just as common are the hydraulic or pneumatic means such as described in Gibson et al.

In the present invention, a mechanical element is employed which overcomes many of the disadvantages of the springs heretofore known. It is difficult to obtain any significant service life when using a leaf or coil spring in the typical rotary compressor environment. With each revolution of the rotor the spring is compressed and released. Since the compressors operate at several hundred R.P.M., it is apparent that the springs undergo flexing at unusually high rates and thus are subject to fatigue failure.

The objective of the present invention is to minimize the amount of flexure involved, especially the total travel distance for each compression and extension of the spring. The present invention employs a novel, three-layer composite spring having (1) a metal portion in contact with the vane to provide the necessary rigidity, (2) a bonded rubber or elastomeric component to extend the life of the metal element, and (3) a bonded fabric wear surface in contact with the bottom of the vane slot to provide resistance to abrasion from rubbing contact with the vane slot and consequent cutting or nicking of the rubber component.

Still another aspect of the invention is the superior load distribution which is accomplished by mating the curved vane bottom with a bridge-like rubber/metal composite spring assembly. Further, the surface provided by the metal spring, in combination with the rubber or elastomeric element, is effective in dampening noise during operation. The fabric wear surface extends the useful life of the composite assembly, thus decreasing the need for expensive maintenance due to failure of the unit.

The assembly is compact, inexpensive to install, and requires no special modifications to conventional compressor parts.

Other advantages to this system include the fact that since no hydraulic means are provided for maintaining the vanes extended, it is not necessary to provide either a lubricant pump or other means for collecting and distributing oil and/or refrigerant to the undervane spaces. It also provides instant pumping action upon start-up, reduces hammering and consequent vane wear caused by delayed movement of the vane to the extended position, eliminates reverse rotation at rotor shutdown often caused by equalization of pressures between the high and low sides of the compressor rotor, and results in lower discharge gas temperature.

BRIEF DESCRIPTION OF THE DRAWINGS

FIG. 4 is a partial perspective view of the resilient element;

FIG. 5 is a cross sectional view taken along the plane of 5—5 of FIG. 3; and

FIG. 6 is a view similar to FIG. 5 showing the resilient element in its fully flexed position.

DESCRIPTION OF THE PREFERRED EMBODIMENT

Figure 1:
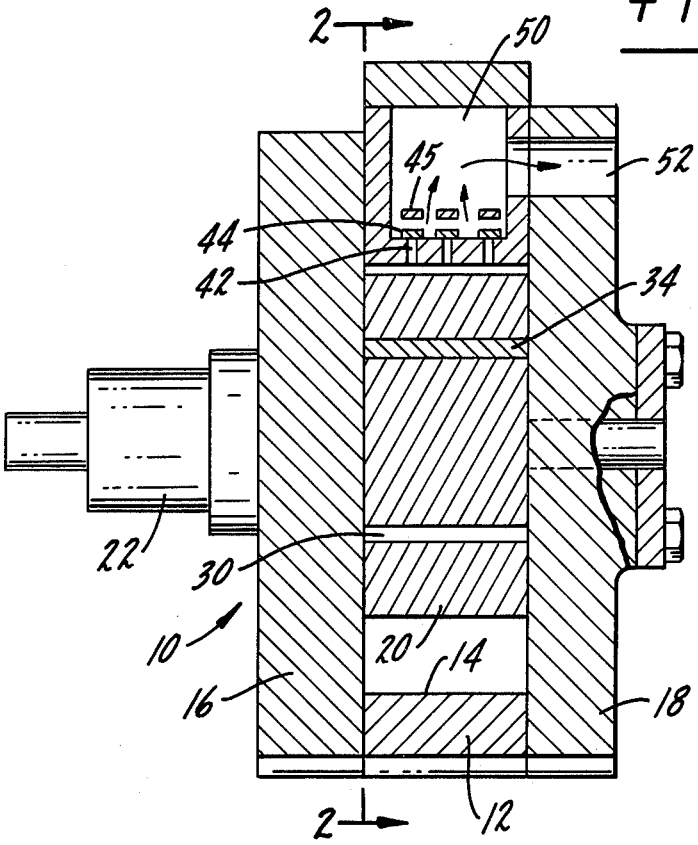
FIG. 1 is a cross sectional view of a rotary sliding vane compressor constructed in accordance with the principles of the present invention.
Figure 3:
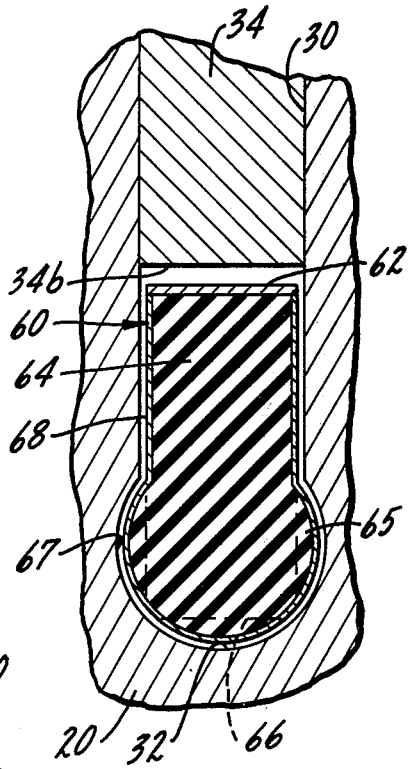
FIG. 3 is a greatly enlarged sectional view showing the relationship of the resilient element with respect to the vane and the vane slot.
Figure 2:
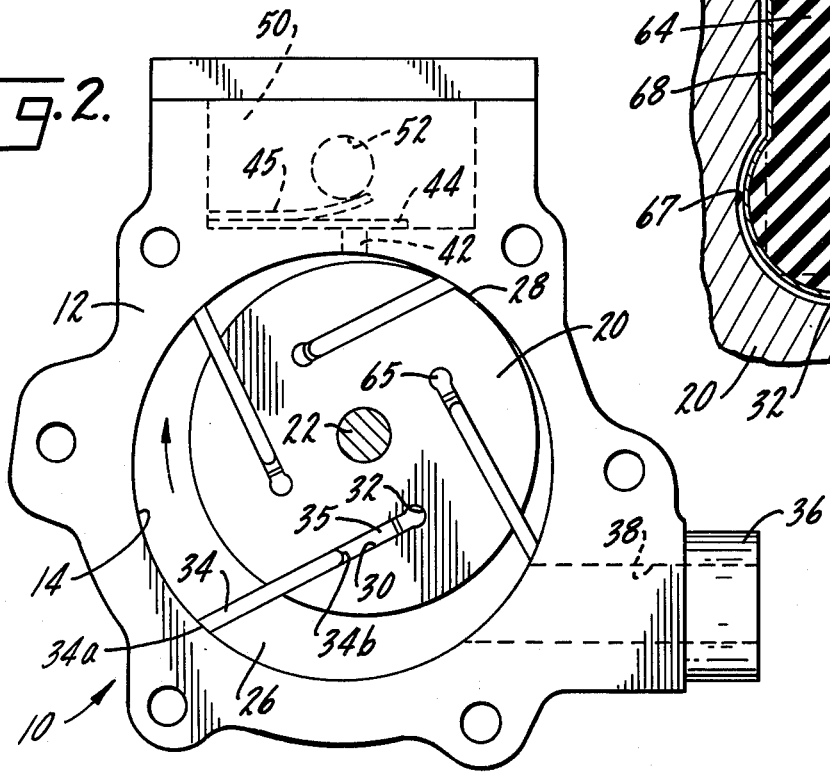
FIG. 2 is a cross sectional view taken along the plane of line 2—2 of FIG. 1.

Referring now to the drawings, particularly to FIGS. 1 and 2, there is shown a typical rotary compressor of generally conventional design including a stator housing 10 comprising a cylinder block 12 having a circular bore extending therethrough to provide a cylinder wall 14, a front end plate 16, and a rear end plate 18. Within housing 10 there is provided a rotor 20 connected to and driven by drive shaft 22. The rotor is eccentrically mounted within the cylinder 14 so that it is in close running contact with the cylinder wall 14 at a contact point 28 and forms a crescent-shaped gas working space or compression cavity 26. The rotor is provided with a plurality of vane slots 30 each having a bottom surface 32 and receiving vanes 34 which are adapted to reciprocate within each vane slot with their upper edges **34*a* in continuous engagement with cylinder wall 14. It may be seen that the lower sides of each slot, the bottom edge 34*b* of the vanes 34, and the bottom of the vane slot 32 define what will be referred to as the "undervane space", designated 35**.

Suction gas is admitted to the compression cavity 26 through connection 36 and passage 38. Gas is discharged through a series of openings 42 (adjacent the contact point) which are covered by reed-type discharge valves 44, limited by valve stops 45. Discharge gas flows into chamber 50 and then through passage 52 in rear plate 18.

Located between the lower edge of each vane and the bottom of the vane slot 32 is a resilient element 60, shown in partial perspective view in FIG. 4, which includes a first component in the form of a flat spring 62 formed of spring steel or other suitable alloy having good wear characteristics and adapted to withstand a large number of flexures at high frequency without failure. Bonded to the spring element is an elastomeric damper 64 having enlarged, spherically-shaped terminal portions 65 and a central section 66 having a relatively thin cross-sectional area as compared to the end portions. The spherically-shaped ends 65 of damper 66 are adapted to seat in complementary sockets 67 formed in the ends of vane slot 32. This arrangement provides pivot points at each end to minimize abrasion of the ends of resilient element 60 against the bottom of the slot, and further operates to maintain the resilient element in the proper location within the vane slot during assembly and while the pump is operating.

Bonded to the peripheral surface of the elastomeric damper 64 is a wear layer 68, formed of woven nylon fabric, or other suitable fabric having good wear characteristics and adapted to stretch elastically at high frequency without failure.

As best shown in FIG. 5, the bottom edge **34*b* of each vane is curved thus forming a convexly shaped edge engageable with the flat spring component 62 of the resilient element 60. When the vanes are fully extended, as shown in FIG. 5, the resilient element 60** lies flat across the entire vane slot region. At this point the resilient element is completely unflexed; and no portion thereof is under either compression or tension.

As best shown in FIG. 6, the resilient element 60, after engagement with convexly shaped edge **34*b*, is in a condition where the resilient element assumes the same general contour as the bottom edge, and the elastomeric portion is forced downwardly so that the central region 66 is closely spaced from the bottom of the vane slot. The spherically-shaped terminal portions 65 are displaced outwardly in contact with the bottom of the vane slot, providing a rubbing contact between the surface of the vane slot and the terminal portion 65** surfaces. At this point, the spring is in a condition to bias the vane upwardly against the inside cylinder wall or stator, and this will result in immediate pumping action upon start-up prior to the generation of enough centrifugal force to hold the vanes in contact with the cylinder wall.

It will be apparent that a long term, high frequency flexing of the resilient element 60 will subject the terminal portions 65 to severe abrasion, particularly in the terminal portion 65 surfaces in rubbing contact with the bottom of the vane slot. The addition of the improved wear layer 68 in the form of a woven fabric protects the terminal portion 65 from abrasion and markedly extends the service life.

While a variety of elastomeric compounds may be used in making element 66, they should be resistant to the oil-refrigerant environment in which they must operate in a refrigeration/air conditioning application. Suitable materials would include urethane, nitrile, epichlorohydrin, fluorocarbon and silicone rubbers.

A number of woven fabric materials may be used in the forming of the wear layer 68, however, it is necessary that such materials be elastic in order to conform to the surfaces during deformation of the composite spring while in use. The preferred materials will stretch at least 25%, preferably greater than 50%, in at least one direction with a high degree of recovery in order to be suitable for the purposes of this invention. A number of such stretch fabrics are commercially available including nylon, polyester and the like, which have the necessary stretch properties together with high wear character and resistance to attack by oil-refrigerant environments in which those pumps are operated.

A suitable fabric for the purposes of this invention is a nylon fabric obtained from Stern and Stern Textile Corporation as pattern A-3274/2 and having a thread count of 104 × 70, weighing 6 to 6.7 oz. per square yard. This fabricis stretchable only in the filler direction of the weave, with a grab tensile of 180 psi, and an elongation of 100%. In the warp direction the fabric has a grab tensile value of 400 psi. The fabric is pretreated on the surface with a resorcinol-formaldehyde resin to provide improved adhesion between the fabric and the rubber component. It is essential that the fabric when applied to the surfaces of the composite spring be oriented so that the stretch (filler) direction of the fabric coincides with the longitudinal axis of the resilient element. The fabric will then stretch and not be torn loose by shear stresses during repeated flexing of the composite spring structure.

The composite spring structure according to this invention was formed by compression molding. First the mold cavity was lined with the fabric, pre-cut and oriented in the mold with the stretch (filler) direction of the weave along the longitudinal axis. A molded preform of the rubber component was then placed in the mold cavity. The leaf spring component, coated with a suitable adhesive such as Ty Ply BN, available from Hughson Chemical Corp., was placed in the mold and the mold was closed, placed under clamping pressure and heated to form the part and cure the rubber and adhesive components. When cooled and removed from the mold the resulting composite spring structure was complete. It will be apparent that the molding operation described is one of many common to the rubber manufacturing art and many variations will thus be possible and even desirable for speed and improved economy of manufacture.

While this invention has been described in connection with certain specific embodiments thereof, it is to be understood that this is by way of illustration and not by way of limitation; and the scope of the appended claims should be construed as broadly as the prior art will permit.

We claim:

1. In a rotary compressor of the type including a cylindrical rotor having a plurality of extensible vanes received in complementary vane slots and a resilient element engageable with the radially inner portion of said vanes and adapted to flex downwardly upon engagement by said vane, said resilient element being a composite structure comprising a metal spring member engageable by the radially inner portion of said vanes, an elastomeric element bonded thereto and a wear surface on said elastomeric element formed of a stretch fabric.

2. In a rotary compressor of the type including a cylindrical rotor having a plurality of extensible vanes received in complementary vane slots and a resilient element engageable with the radially inner portion of said vanes and adapted to flex downwardly upon engagement by said vane, said resilient element being a composite structure comprising a metal spring member engageable by the radially inner portion of said vanes, an elastomeric element bonded thereto having spherically shaped terminal portions received in complementary sockets formed at the ends of each vane slot, and a wear surface on said elastomeric element formed of a stretch fabric.

3. The apparatus as defined in claim 2 wherein said stretch fabric is capable of being stretched elastically at least 25% in length.

4. The apparatus as defined in claim 2 wherein said stretch fabric is selected from the group consisting of nylon and polyester woven stretch fabric capable of being stretched at least 25% in length.

* * * * *